US008641429B2

(12) United States Patent
Fish et al.

(10) Patent No.: US 8,641,429 B2
(45) Date of Patent: Feb. 4, 2014

(54) SFP SUPER CAGE

(75) Inventors: Ilan Fish, Givatayim (IL); Albert Kleyman, Ashdod (IL); Tsvi Eitane, Netanya (IL)

(73) Assignee: RAD Data Communications Ltd., Tel Aviv (IL)

( * ) Notice: Subject to any disclaimer, the term of this patent is extended or adjusted under 35 U.S.C. 154(b) by 8 days.

(21) Appl. No.: 13/372,544

(22) Filed: Feb. 14, 2012

(65) Prior Publication Data

US 2013/0210275 A1 Aug. 15, 2013

(51) Int. Cl.
*H01R 12/00* (2006.01)

(52) U.S. Cl.
USPC ..... 439/76.1

(58) Field of Classification Search
USPC ..... 439/76.1, 577, 638, 620.01, 620.22; 385/92–94, 54; 398/135, 64
See application file for complete search history.

(56) References Cited

U.S. PATENT DOCUMENTS

| | | | | |
|---|---|---|---|---|
| 6,881,095 | B2 * | 4/2005 | Murr et al. | 439/607.2 |
| 6,945,712 | B1 * | 9/2005 | Conn | 385/94 |
| 7,179,096 | B2 * | 2/2007 | Dube et al. | 439/76.1 |
| 7,213,979 | B2 | 5/2007 | Park | |
| 7,317,733 | B1 | 1/2008 | Olsson et al. | |
| 7,325,975 | B2 * | 2/2008 | Yamada et al. | 385/54 |
| 7,331,819 | B2 * | 2/2008 | Nelson et al. | 439/577 |
| 7,335,033 | B1 * | 2/2008 | Edwards et al. | 439/76.1 |
| 7,613,021 | B2 * | 11/2009 | Lanni | 363/80 |
| 7,693,178 | B2 | 4/2010 | Wojtowicz | |
| 7,714,433 | B2 * | 5/2010 | Campini et al. | 257/722 |
| 7,792,046 | B2 * | 9/2010 | Kucharczyk et al. | 370/244 |
| 7,933,518 | B2 * | 4/2011 | Li et al. | 398/22 |
| 7,934,959 | B2 | 5/2011 | Rephaeli et al. | |
| 8,075,199 | B2 * | 12/2011 | Losio et al. | 385/92 |
| 8,320,930 | B2 * | 11/2012 | Stanwood et al. | 455/454 |
| 2002/0149821 | A1 * | 10/2002 | Aronson et al. | 359/152 |
| 2005/0105915 | A1 * | 5/2005 | Light | 398/164 |
| 2006/0093285 | A1 * | 5/2006 | Park | 385/92 |
| 2006/0209886 | A1 | 9/2006 | Silberman et al. | |
| 2007/0010132 | A1 * | 1/2007 | Nelson et al. | 439/577 |
| 2009/0257754 | A1 * | 10/2009 | Theodoras et al. | 398/135 |

FOREIGN PATENT DOCUMENTS

WO 2009070062 6/2009

OTHER PUBLICATIONS

International Search Report mailed Jun. 21, 2013 for corresponding PCT application PCT/IB2013/051106; international filed Feb. 11, 2013.

International Telecommunication Union—ITU-T; Y.1731; Series Y: Global Information Infrastructure, Internet Protocol Aspects and Next-Generations Networks; OAM Functions and Mechanism for Ethernet based networks; Feb. 2008.

(Continued)

*Primary Examiner* — Alexander Gilman
(74) *Attorney, Agent, or Firm* — A.C. Entis-IP Ltd.

(57) ABSTRACT

An embodiment of the invention provides a super cage for receiving and providing a small form factor pluggable (SFP) communication module with a functionality, the super cage comprising: a sleeve dimensioned to receive an SFP communication module and be plugged into a conventional SFP cage having a socket for receiving an SFP connector of an SFP module; functionality circuitry housed in the sleeve; a cage connector electrically connected to the functionality circuitry and configured to be inserted into the conventional cage socket; and a coupling socket housed in the sleeve that receives an SFP connector of an SFP module and electrically connects the SFP connector to the functionality circuitry.

20 Claims, 10 Drawing Sheets

(56) References Cited

OTHER PUBLICATIONS

IEEE Standard for Information Technology—Telecommunications and information exchange between systems—Local and metropolitan area networks—Specific Requirements; Part 3: Carrier Sense Multiple Access with Collision Detection (CSMA/CD) access method and Physical Layer specifications; Section Five; Clause 57, IP performance measurement via One-Way or Two-Way Active-Measurement Protocol (OWAMP/TWAMP).

Metro Ethernet Forum Technical Specification; MEF 10.2; Ethernet Services Attributes Phase 2; Oct. 27, 2009.

S. Shalunov et al; A One-way Active Measurement Protocol (OWAMP), Network Working Group, Internet2, Sep. 2006.

K. Hedayat et al; A Two-Way Active Measurement Protocol (TWAMP), Network Working Group, Nortel Networks, Oct. 2008.

* cited by examiner

SFP SUPER CAGE

TECHNICAL FIELD

Embodiments of the invention relate to small form factor pluggable (SFP) communication modules and cages that receive these modules.

BACKGROUND

With the expansion of communication networks to connect ever more people to each other and to sources of entertainment and information, and to support autonomous communication between devices that support modern technology and culture, the networks have provided an enormous increase in communication connectivity and bandwidth. The physical infrastructures that support the networks have become increasingly more complex and have developed to enable an increasing variety of communication functionalities.

To provide for a greater variety of functionalities, optical fiber interfaces have, by practical necessity, been configured in small modules that are easily mounted onto communications equipment. By using such modules, communications equipment can be easily adapted to a large variety of optical fiber physical layers, such as single-mode or multi-mode fiber; short-range (less than 1 km), long range (10 km), or extended-range (80 km) coverage; different wavelengths of light such as 850, 1310, 1490, or 1550 nm (nanometer); and single wavelength, Coarse Wavelength Division Multiplexing (CWDM), or Dense Wavelength Division Multiplexing (DWDM). Without such modules communications equipment vendors would need to manufacture a wide variety of equipment, identical in communications functionality but differing in fiber optical interface characteristics.

Modern versions of these communications modules are pluggable, i.e. they may easily be inserted into and removed from matching receptacles, referred to as "cages" mounted on panels of communications equipment, such as switches and routers. The cages serve to mechanically and electronically connect the communication modules inserted into the cages to the communications equipment.

Standards for small communication modules, such as Small Form-factor Pluggable (SFP) modules, Enhanced Small Form-factor Pluggable (SFP+) modules, 10G Form-factor Pluggable (XFP) modules, 100G Form-factor Pluggable (CFP) modules, and Gigabit Interface Converter (GBIC) modules, have been specified by industry groups in agreements known as "multisource agreements (MSA)". Multisource agreements specify electrical, optical, and physical features of the modules. Hereinafter the acronym "SFP" may be used generically to reference small communication modules, such as any of the exemplary small communication modules noted above.

Conventional small communications modules such as SFPs are limited in functionality to performing electric to optical and optical to electric conversions. Recently, additional functionalities have been implemented inside such modules, effectively turning these modules into sophisticated network elements in their own right. For example, U.S. Pat. No. 7,317,733 to Olsson and Salemi describes performing Ethernet to TDM protocol conversion inside an SFP. US patent application 2006/0209886 to Silberman and Stein further describes pseudowire encapsulation inside an SFP. U.S. Pat. No. 7,933,518 to Li et al describes performing optical loopback and dying gasp inside an SFP. U.S. Pat. No. 7,693,178 to Wojtowicz describes inserting Passive Optical Network ONU functionality into an SFP. SFPs and similar pluggable modules with such additional functionalities save rack space, power, and cabling, but suffer from the same deficiency as communications equipment before the introduction of SFPs, namely that vendors need to manufacture a wide variety of SFPs identical in communications functionality while differing only in fiber optical interface characteristics.

SUMMARY

An embodiment of the invention relates to providing a receptacle, referred to as a "super cage", that can be plugged into a conventional SFP cage and into which an SFP module can be plugged and electrically connected to mechanically and electrically connect the SFP module to the conventional cage. The super cage comprises circuitry and/or devices, hereinafter also referred to as "functionality circuitry", that provides the SFP module with an additional functionality and/or services, hereinafter generically referred to as a "functionality". A "conventional cage" hereinafter refers to a receptacle that conforms to an MSA standard.

In accordance with an embodiment of the invention, the functionality circuitry provides a processing functionality, such as by way of example, protocol translation and/or a dying gasp alarm, for the SFP module. Optionally, the functionality circuitry comprises a mini-fan that generates air flow through the super cage and the SFP module to enhance dissipation of heat from the module.

In the discussion, unless otherwise stated, adjectives such as "substantially" and "about" modifying a condition or relationship characteristic of a feature or features of an embodiment of the invention, are understood to mean that the condition or characteristic is defined to within tolerances that are acceptable for operation of the embodiment for an application for which it is intended.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF FIGURES

Non-limiting examples of embodiments of the invention are described below with reference to figures attached hereto that are listed following this paragraph. Identical structures, elements or parts that appear in more than one figure are generally labeled with a same numeral in all the figures in which they appear. Dimensions of components and features shown in the figures are chosen for convenience and clarity of presentation and are not necessarily shown to scale.

DETAILED DESCRIPTION

In the following detailed description, conventional SFPs and SFP cages are discussed with reference to FIGS. 1A-1C. FIGS. 2A-2D schematically show a super cage being inserted into a conventional SFP cage and how it accommodates an SFP module. FIGS. 3A-3H show parts of a super cage and their features and illustrate how they are assembled in a super cage, in accordance with an embodiment of the invention. Various functionalities that may be provided by a super cage in accordance with embodiments of the invention are discussed with reference to FIGS. 4A-4D.

Figure 1A:
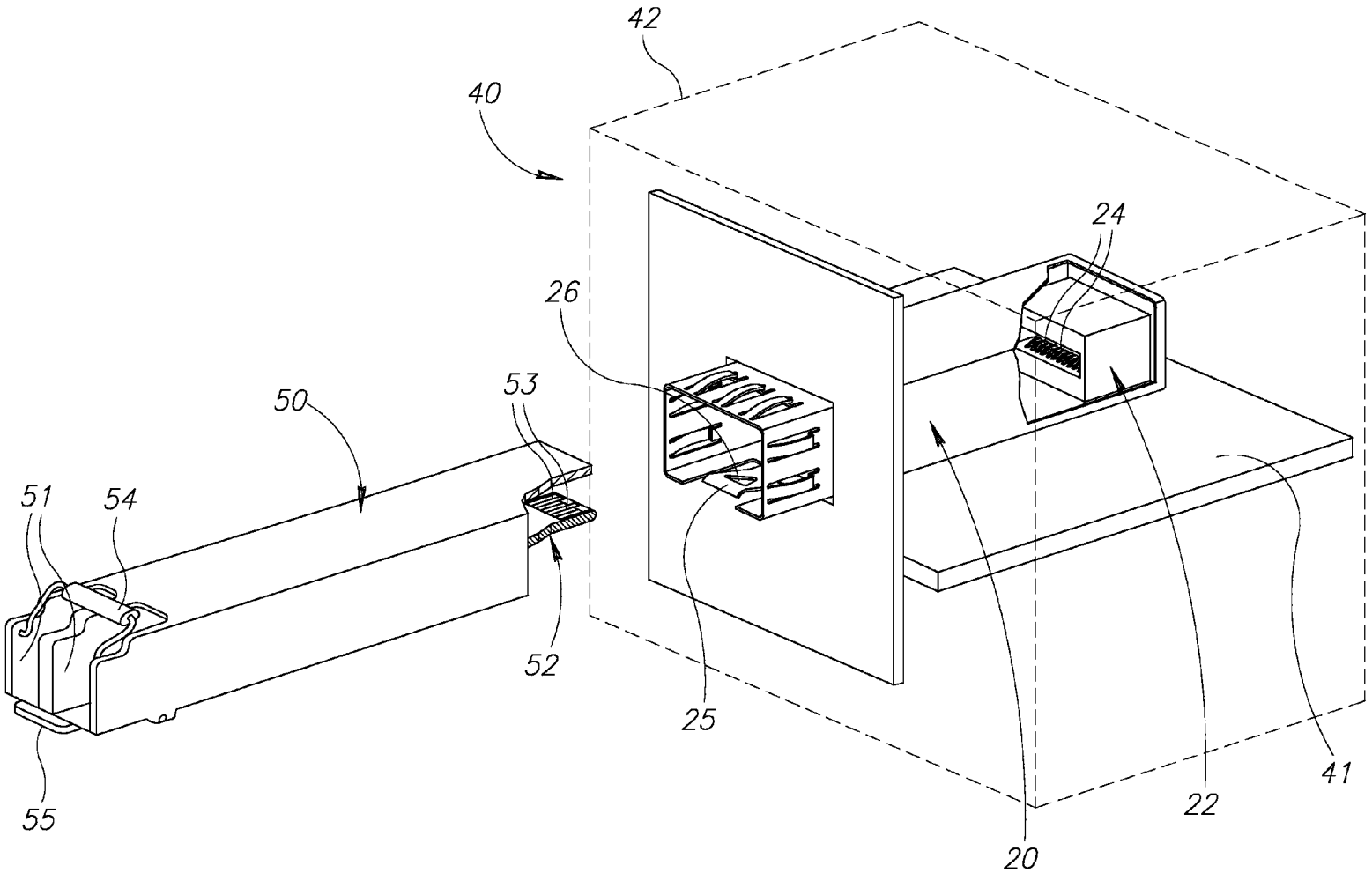
FIG. 1A schematically shows a conventional SFP cage and an SFP module that may be plugged into the cage.
Figure 1B:
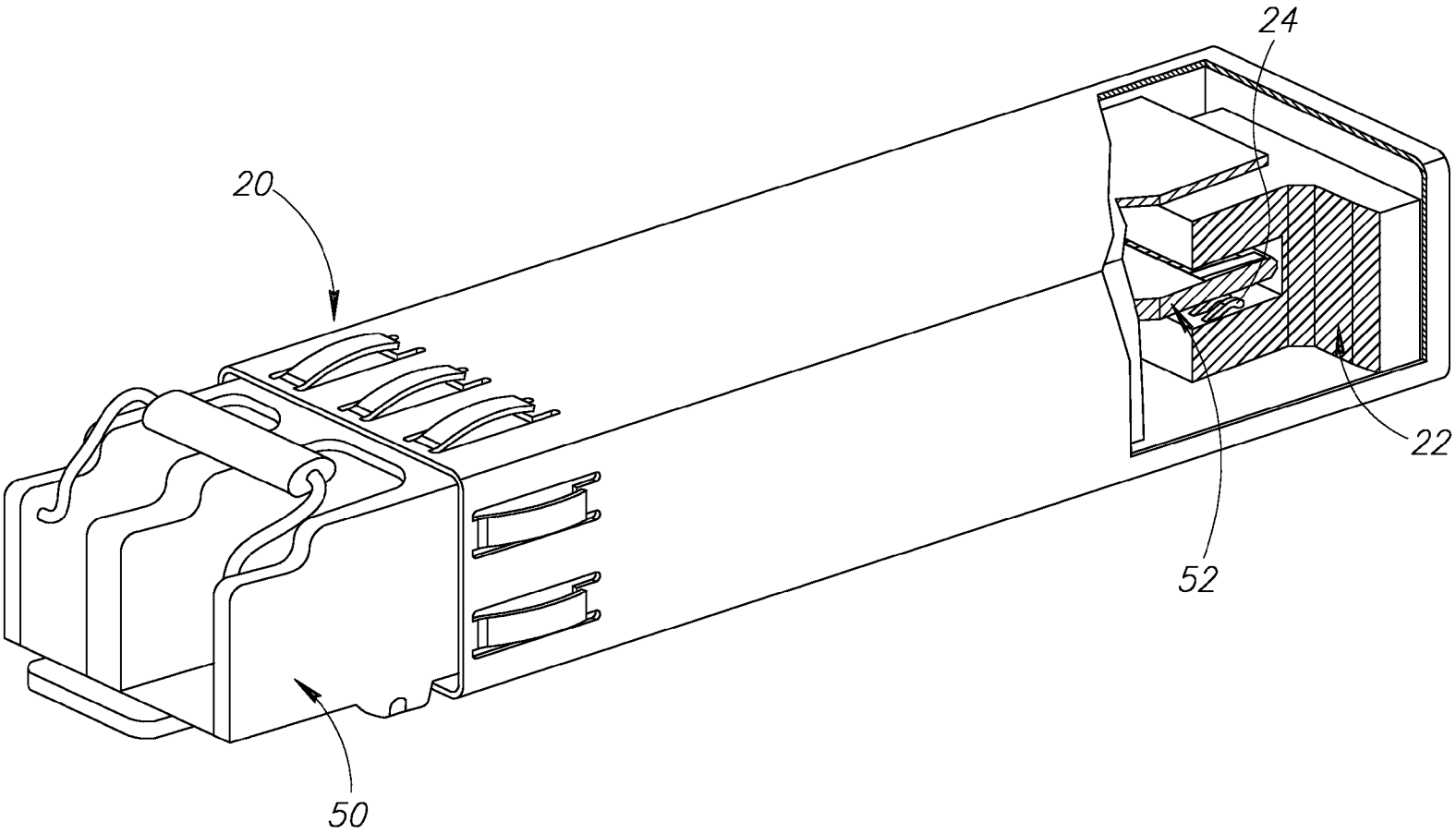
FIG. 1B schematically shows the conventional SFP cage shown in FIG. 1A with the SFP module plugged into the cage.
Figure 1C:
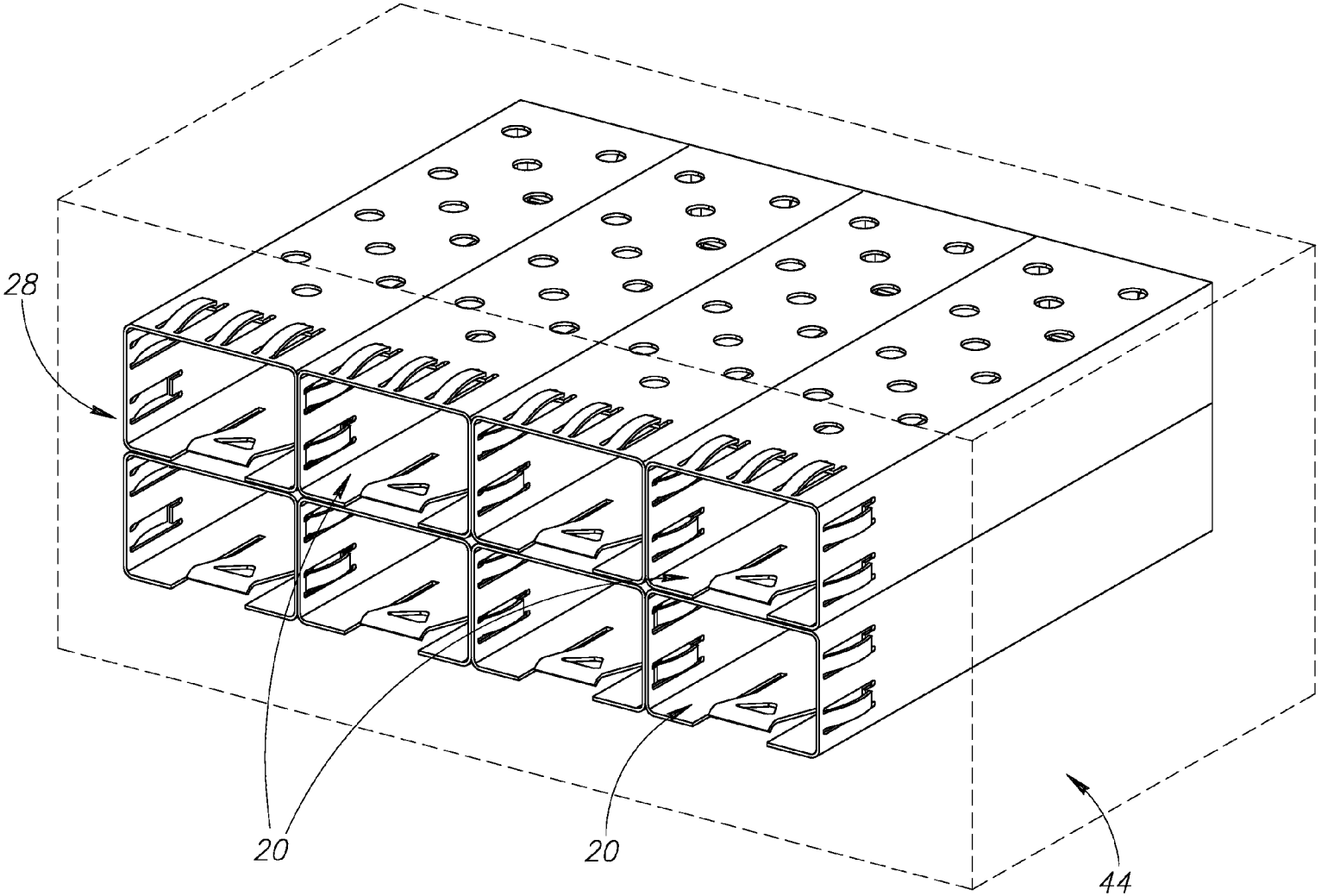
FIG. 1C schematically shows an array of conventional SFP cages for receiving SFP modules.

FIG. 1A schematically shows a conventional SFP cage 20 mounted on printed circuit board (PCB) 41 of a communication device 40 housed in a chassis schematically represented by dashed lines 42. The figure also shows an SFP module 50 that may be inserted into the conventional SFP cage to connect the SFP module to circuitry in PCB 41. The conventional SFP cage and SFP module are partially cutaway to show details of their features discussed below. By way of example, SFP module 50 is assumed to be an optical transceiver configured having two optical connectors 51 that mate with optical fibers over which optical signals are received and transmitted by the transceiver.

SFP module 50 comprises an edge connector 52, which has conductive contacts 53 that are electrically connected to circuitry (not shown) in the SFP. Whereas conductive contacts 53 are shown only on the upper side of the connector, they may be on the upper and/or the lower of the connector. SFP cage 20 comprises a cage socket 22 having conducting contacts 24 that match conducting contacts 53 and are electrically connected to conductive traces (not shown) in host PCB 41. The conductive races in host PCB 41 connect the conducting contacts of the socket to circuitry (not shown) in communications device 40. Cage socket 22 is configured to receive connector 52 and connect conductive contacts 53 of the connector to matching conductive contacts 24 in cage socket 22, and thereby to electrically connect the transceiver to circuitry in communication device 40.

Conventional SFP cage 20 optionally comprises a spring latch 25 formed having a hole 26 that receives and engages a matching "latch button" (not shown) in SFP transceiver 50 to lock the SFP transceiver in the cage when it is fully inserted into the cage. A release lever 54 is pulled downward to push a slider 55 (only a portion of which is shown in FIG. 1A) in the SFP transceiver so that it contacts and depresses spring latch 25 to disengage the spring latch from the latch button. With the latch button disengaged, the SFP may be extracted from conventional SFP cage 20. FIG. 1B schematically shows SFP transceiver 50 fully inserted into conventional SFP cage 20 and connector 52 plugged into cage socket 22.

Generally, a communication device, such as a switch or router, comprises a bank of conventional SFP cages and is configured to receive and process signals from a plurality of different SFP modules. FIG. 1C schematically shows a communication device 44 comprising a bank 28 of conventional SFP cages 20. Often it is desired to provide given SFP modules plugged into cages in a communication device such as communication devices 40 and 44 with additional functionalities that are not provided by the communication device. Typically, this requires adding additional communication devices, providing them with rack-space and electrical power, connecting these additional devices to existing devices with optical fibers and/or electrical wires, and configuring/managing these devices via a network management system.

Figure 2A:
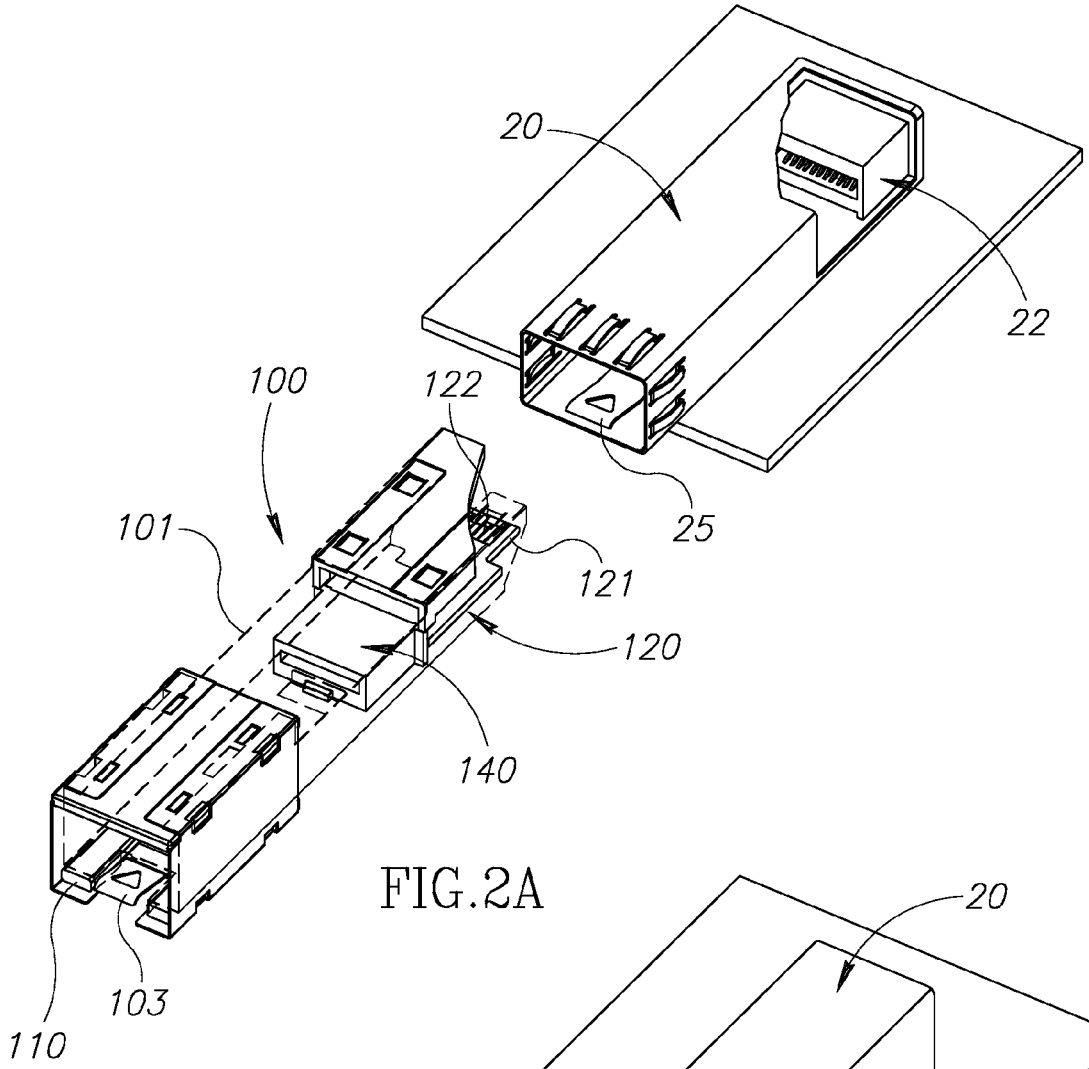
FIGS. 2A and 2B schematically show a super cage being inserted into and after insertion into a conventional SFP cage respectively, in accordance with an embodiment of the invention.
Figure 2B:
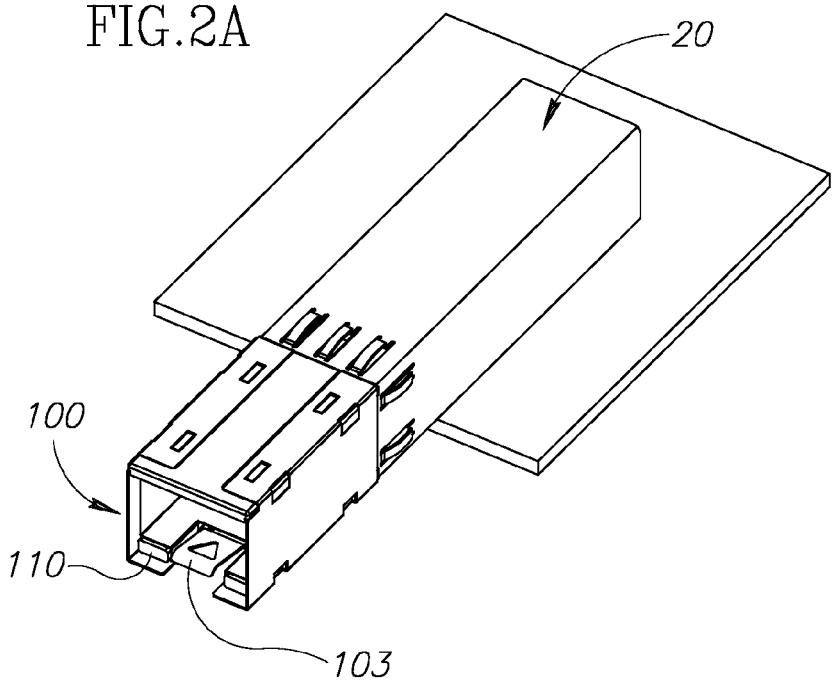

Super cages, in accordance with embodiments of the invention conveniently provide additional functionalities for SFP modules generally without need for re-cabling and reconfiguring physical communication equipment. FIGS. 2A and 2B schematically show a super cage 100 before and after being inserted into a conventional SFP cage 20 respectively, in accordance with an embodiment of the invention.

Super cage 110 optionally comprises a sleeve 101 housing a "functionality" printed circuit board (PCB) 120 and a coupling socket 140. The sleeve is shown in dashed lines in FIG. 2A to indicate that internal features of the super cage are shown as if the sleeve is transparent.

In an embodiment, the super cage further comprises a latch button (not shown) similar to a latch button in an SFP module that is engaged by spring latch 25 of SFP cage 20 to lock the super cage in the SFP cage when the super cage is fully inserted into the SFP cage. A release slider 110, only an edge of which is shown in FIG. 2A and FIG. 2B, is pushed to depress spring latch 25 of SFP cage 20 and disengage the super cage latch button from the spring latch to release the super cage from SFP cage 20.

Coupling socket 140 is configured to receive an SFP connector of a conventional SFP module, hereinafter assumed by way of example to be SFP transceiver 50 (FIG. 1A), inserted into super cage 100. The coupling socket 140 electrically connects the conventional SFP module to functionality PCB 120 when the module is inserted into the super cage. Functionality PCB 120 may comprise any of various functionality circuitries for providing the super cage and thereby SFP transceiver 50, when inserted into the super cage, with an additional functionality.

Figure 2C:
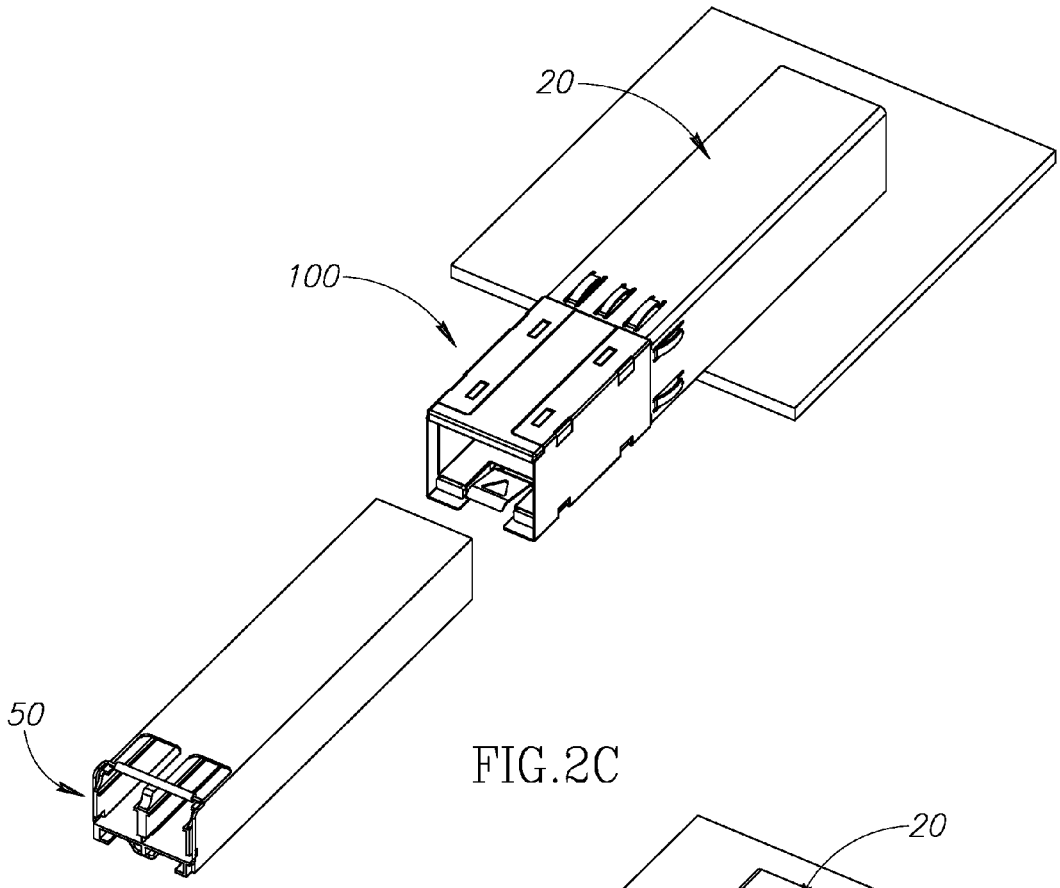
FIGS. 2C and 2D schematically show an SFP module being inserted into and after insertion into a super cage respectively, in accordance with an embodiment of the invention.
Figure 2D:
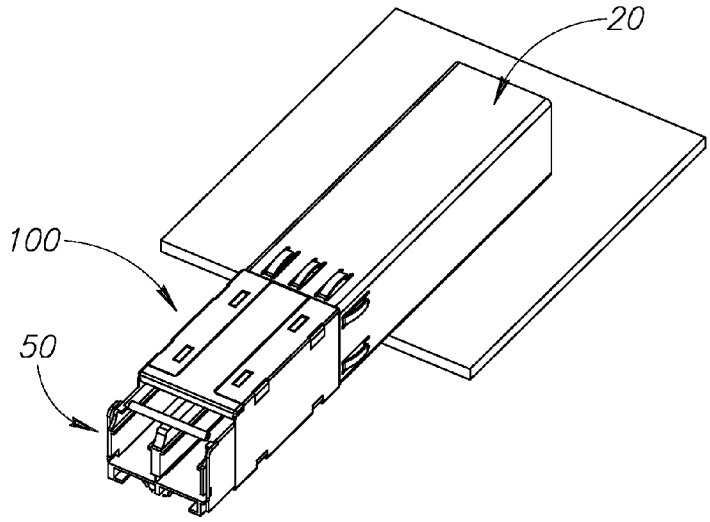

Functionality PCB 120 comprises a cage connector 121 having conductive contacts 122 that are electrically connected to the functionality circuitry (not shown in FIG. 2A) it comprises. The cage connector and its conductive contacts are configured to be inserted into cage socket 22 of conventional SFP cage 20 and electrically connect the functionality circuitry and SFP transceiver 50 with the conventional SFP cage. Super cage 100 is formed having a spring latch 103 similar to spring latch 25 in conventional SFP cage 20. Spring latch 103 locks SFP transceiver 50 in the super cage when the SFP transceiver is fully inserted into the super cage. FIGS. 2C and 2D schematically show SFP transceiver 50 respectively before and after insertion into super cage 100 shown after the super cage is plugged into conventional cage 20, as shown in FIG. 2B.

Features and details of super cage 100 are discussed below with reference to FIGS. 3A-3H. Exemplary functionalities that may be included in functionality PCB 120 in accordance with embodiments of the invention are discussed below with reference to variations of functionality PCB 120 shown FIG. 4A-4C.

Figure 3A:
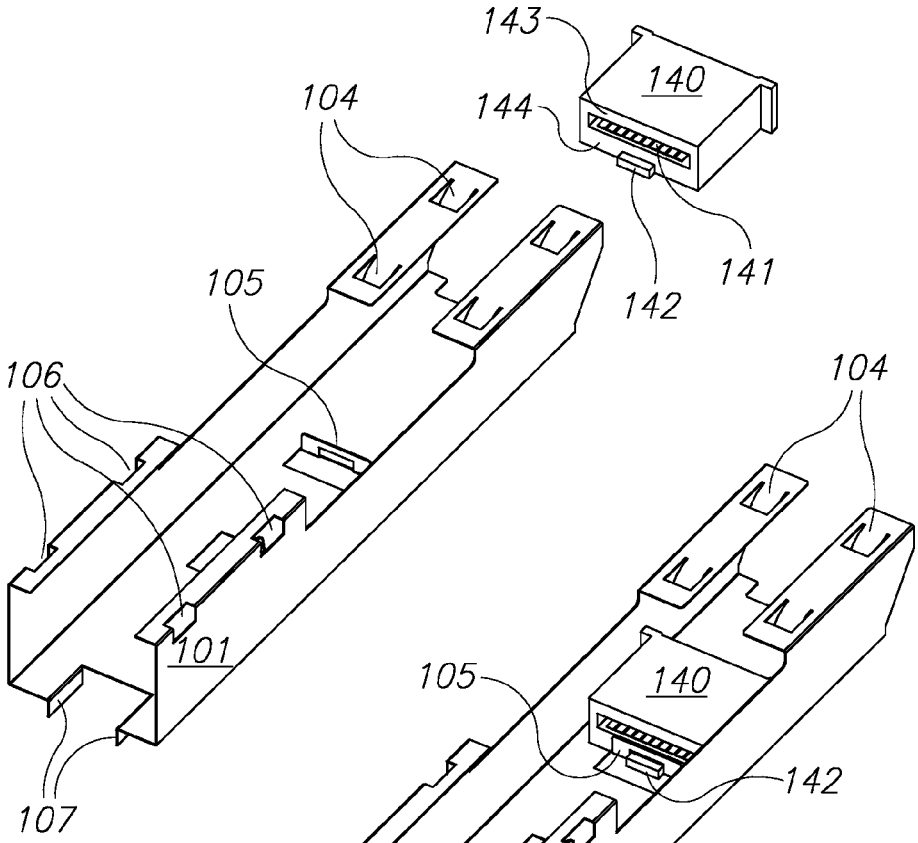
FIGS. 3A-3H schematically show parts of a super cage and illustrate their assembly to provide a super cage in accordance with an embodiment of the invention.
Figure 3B:
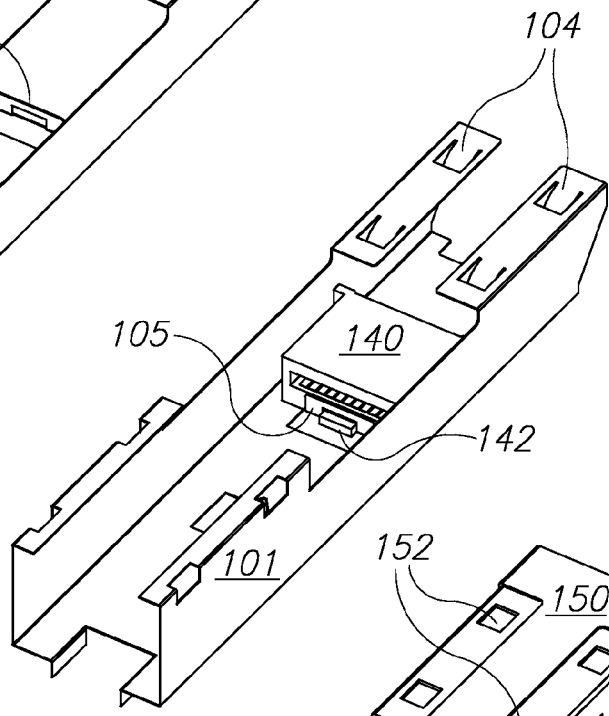

FIGS. 3A and 3B schematically show sleeve 101 and coupling socket 140, shown in FIG. 2A and referred to above, of super cage 100 before assembly and after assembly respectively, in accordance with an embodiment of the invention. Sleeve 101 has external dimensions matched to internal dimensions of a conventional SFP cage, such as conventional SFP cage 20 shown in FIGS. 2A-2D so that the sleeve can be inserted into the conventional SFP cage. Optionally, the sleeve is formed by stamping and bending from a thin sheet of steel optionally about 0.1 mm thick.

In an embodiment of the invention sleeve 101 is formed having snap tabs 104, a stop catch 105, side lock openings 106, and guide fins 107. Coupling socket 140 is optionally injection molded from a suitable polymer and is formed having a socket cavity 141 and catch nub 142. Upper and lower walls 143 and 144 of socket cavity 141 are formed having conductive contacts 145, which are shown in the perspective of the figure only on bottom wall 144. FIG. 3B schematically shows coupling socket 140 assembled into sleeve 101 with the coupling socket catch nub 142 seated in stop catch 105.

Figure 3C:
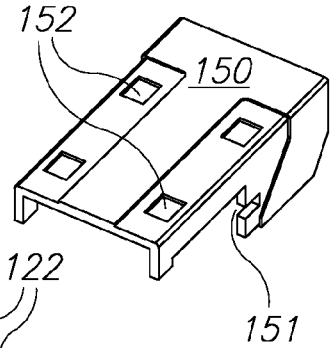
Figure 3C:
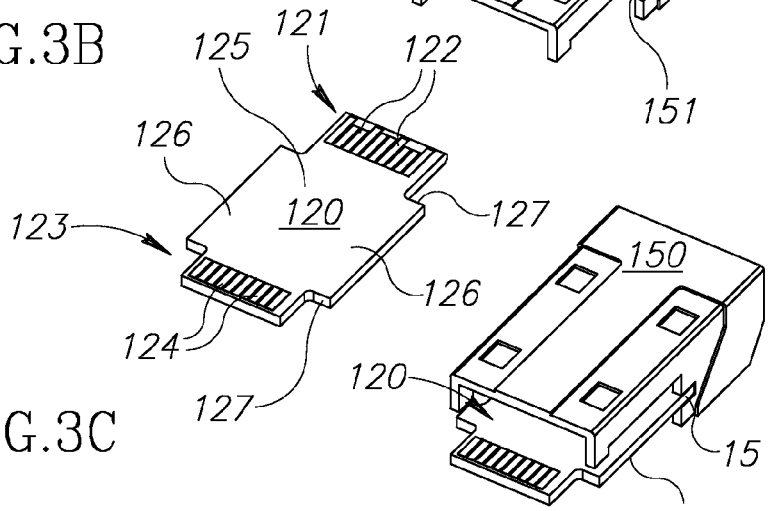

FIG. 3C schematically shows functionality PCB 120 and a back-end cowling 150 that is configured to receive the functionality PCB and lock it into sleeve 101. Functionality PCB 120 comprises in addition to cage connector 121 noted above, a PCB coupling connector 123 having conductive contacts 124. The cage and PCB coupling connectors 121 and 123 straddle a region 125, hereinafter a functionality region 125. Functionality region 125 may comprise any of various functionality circuitries for providing SFP transceiver 50 with an additional functionality. Coupling connector 123 is configured to be inserted into coupling socket 140 and electrically connect functionality PCB and its functionality circuitry to the coupling connector and SFP transceiver 50 when the transceiver is plugged into super cage 100.

Figure 3D:
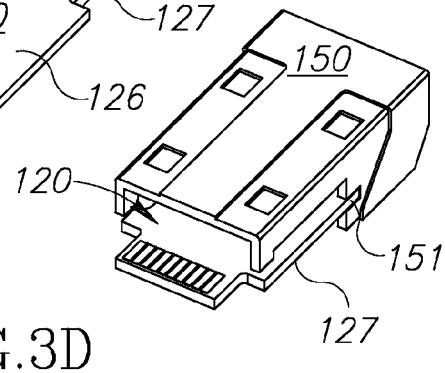
Figure 3E:
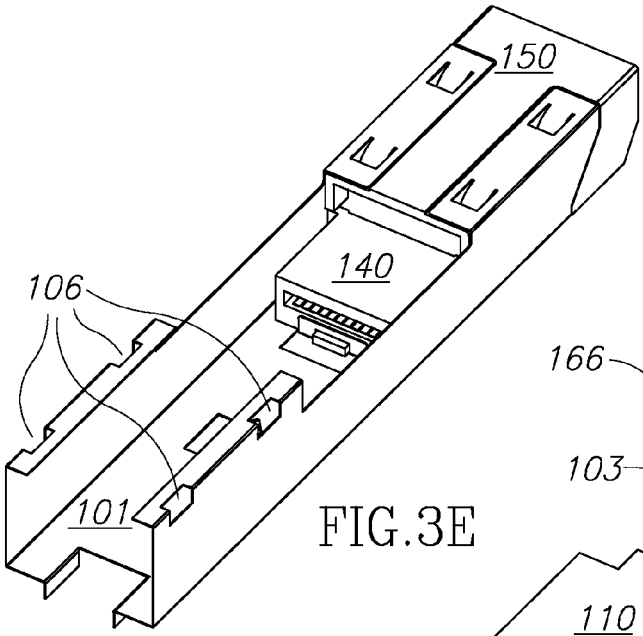

In an embodiment of the invention functionality PCB 120 comprises protruding sidebars 126 that provide the functionality PCB with shoulders 127. Optionally, back-end cowling 150 is formed having slots 151, shown in the perspective of FIG. 3D on only side of the cowling, for receiving sidebars 126 as schematically shown in FIG. 3D, and recesses 152 for receiving snap tabs 104 (FIGS. 3A, 3B). Back-end cowling 150 and functionality PCB 120 are mounted to sleeve 101 by inserting the back-end cowling and functionality PCB into sleeve 101 so that PCB coupling connector 123 is inserted into coupling socket 140 and snap tabs 104 snap into snap recesses 152 as schematically shown in FIG. 3E. With the snap tabs snapped into the snap recesses, coupling socket 140, functionality PCB 120, and back-end cowling 150 are securely locked in place in sleeve 101.

Figure 3F:
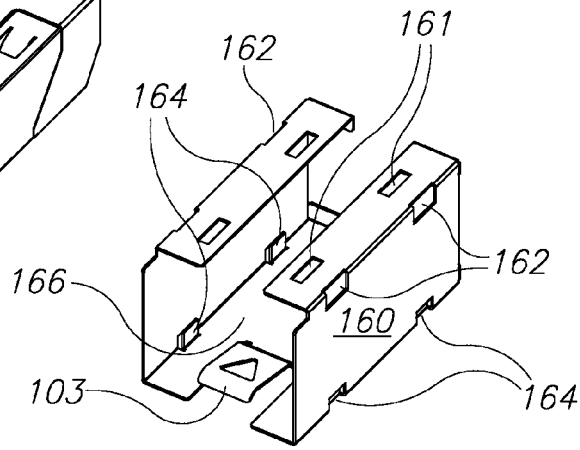

FIG. 3F schematically shows release slider 110 and a front-end cowling 160 that receives the release slider and mounts the slider to sleeve 101 in accordance with an embodiment of the invention. Front-end cowling 160 is optionally formed by stamping and bending from a thin steel plate optionally having thickness of about 0.1 mm. In an embodiment of the invention, front-end cowling 160 is formed having top and side lock openings 161 and 162 respectively, spring latch 103 referred to above, and guide tabs 164.

Release slider 110 comprises a depressor tongue 111 for depressing spring latch 25 (FIG. 2A) of conventional SFP cage 20 and unlocking and releasing super cage 100 from the conventional SFP cage after it has been inserted and locked into the conventional SFP cage. The release slider is formed having a bay 112 and seats on a bottom 166 of front-end cowling 160 with spring latch 103 positioned in the bay so that the release slider may slide back and forth between guide tabs 164. The release slider is formed having shoulders 113 that limit the sliding motion of the slider between guide tabs 164.

Figure 3G:
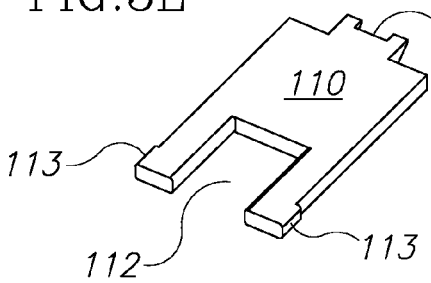
Figure 3G:
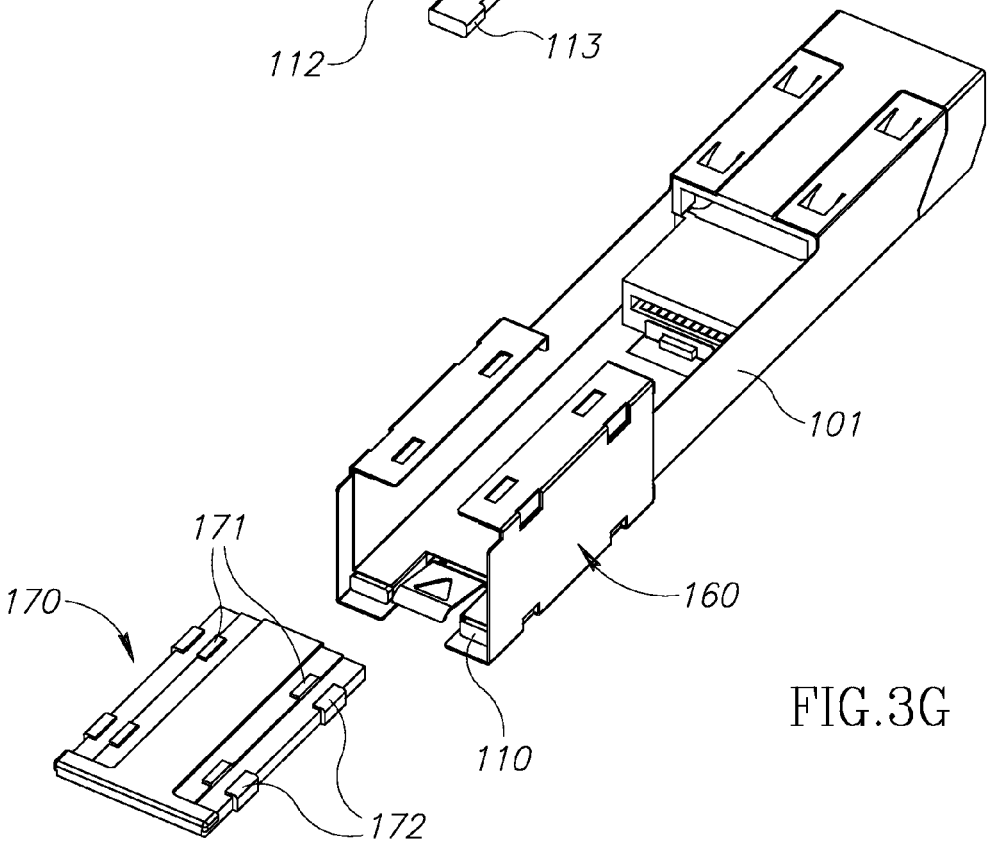
Figure 3H:
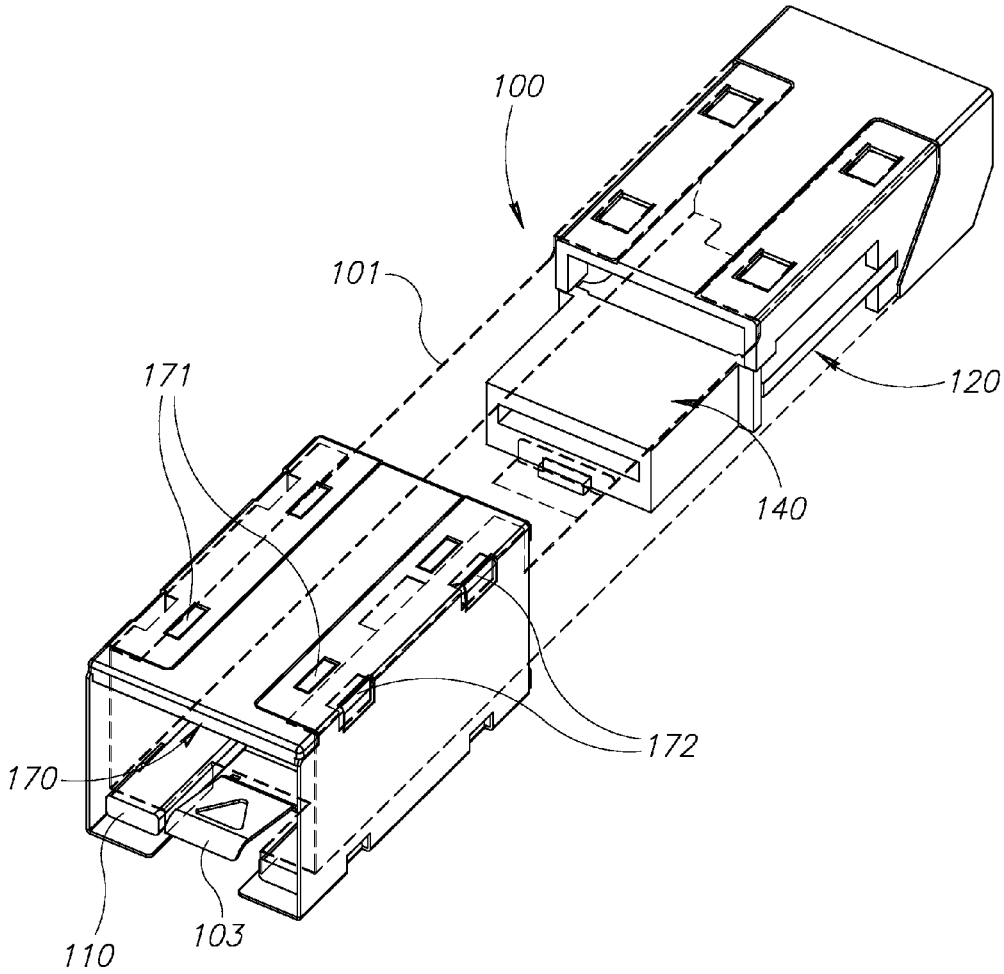

FIG. 3G schematically shows front-end cowling 160 and release slider 110 mounted to sleeve 101 with side lock openings 106 of sleeve 101 and side lock openings 162 of front-end cowling 160 aligned but the cowling not locked into place in the sleeve. Front-end cowling 160 and release slider 110 are locked to sleeve 101 by a locking panel 170. Locking panel 170 is optionally formed from an injection-molded polymer and comprises top locking nubs 171 and side locking nubs 172. When pushed into place, as schematically shows in FIG. 3H, top locking nubs 171 seat into top lock openings 161 of front-end cowling 160 and side locking nubs 172 seat into aligned side lock openings 106 and 162 of sleeve 101 and front-end cowling 160. When properly seated, the locking nubs lock front-end cowling 160, release slider 110 and locking panel 170 in place in an assembled super cage 100 shown in FIG. 3H and FIG. 2A, in accordance with an embodiment of the invention.

In an embodiment of the invention, functionality region 125 contains electric circuitry and/or a Field Programmable Gate Array (FPGA) and/or an Application Specific Integrated Circuit and/or a Central Processing Unit (CPU), in order to provide an additional functionality. Such functionality may include packet inspection, statistics collection, packet header editing, packet insertion and removal, and traffic conditioning.

Packet inspection, including Deep Packet Inspection, may be employed in order to detect anomalous or potentially malicious packets, or to classify packets and collect statistics regarding applications in use, or to monitor and optionally police/shape traffic flows.

Packet header editing may be used for packet marking (e.g., drop eligibility marking), manipulation of Ethernet VLAN tags (insertion of a tag, deletion of a tag, swapping a tag value), manipulation of MPLS label stacks (pushing a label(s), swapping a label, popping a label), or protocol conversion (Rate Interface Conversion, TDM to packet conversion, pseudowire encapsulation, etc.).

Packet insertion and deletion may be used for Operations, Administration, and Maintenance functionality (e.g., Ethernet OAM according to ITU-T Recommendation Y.1731 and or IEEE 802.3 Clause 57, IP performance measurement via One-Way or Two-Way Active Measurement Protocol (OWAMP/TWAMP), and for terminating control or management protocols. In an embodiment, the functionality region is configured to pass most packets transparently from the conventional SFP to the cage socket, but to be responsive to specific OAM or performance measurement packets. In an embodiment, the functionality region may be configured as a reflector or responder that reflects packets with specific characteristics back to their source, or selective responds to packets with specific characteristics.

Traffic conditioning may be used to match traffic parameters to configured levels, such as Ethernet bandwidth profiles as defined in Metro Ethernet Forum Technical Specification MEF-10.2. In an embodiment of the invention, packet inspection, header editing, and OAM functionalities are combined with traffic conditioning to implement an Ethernet Network Interface Device (NID) or Ethernet Network Termination Unit (NTU).

Figure 4B:
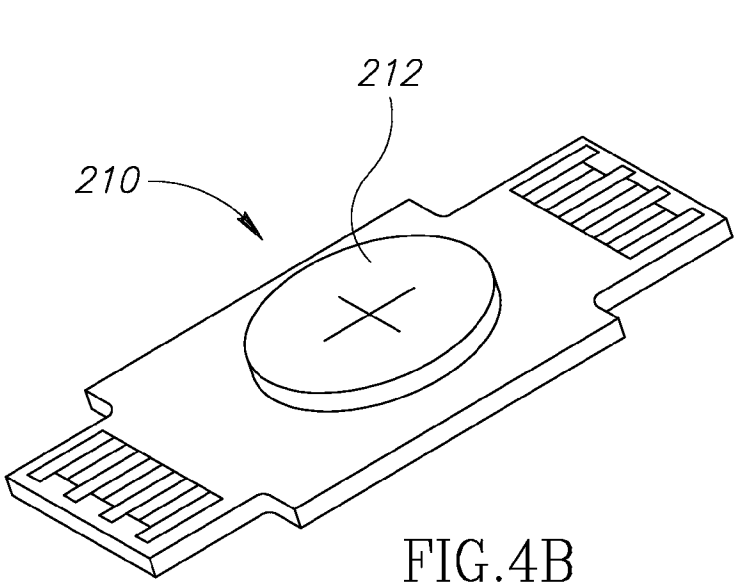
FIG. 4A-4C schematically shows exploded or transparent views of super cages configured to provide different functionalities in accordance with embodiments of the invention.
Figure 4A:
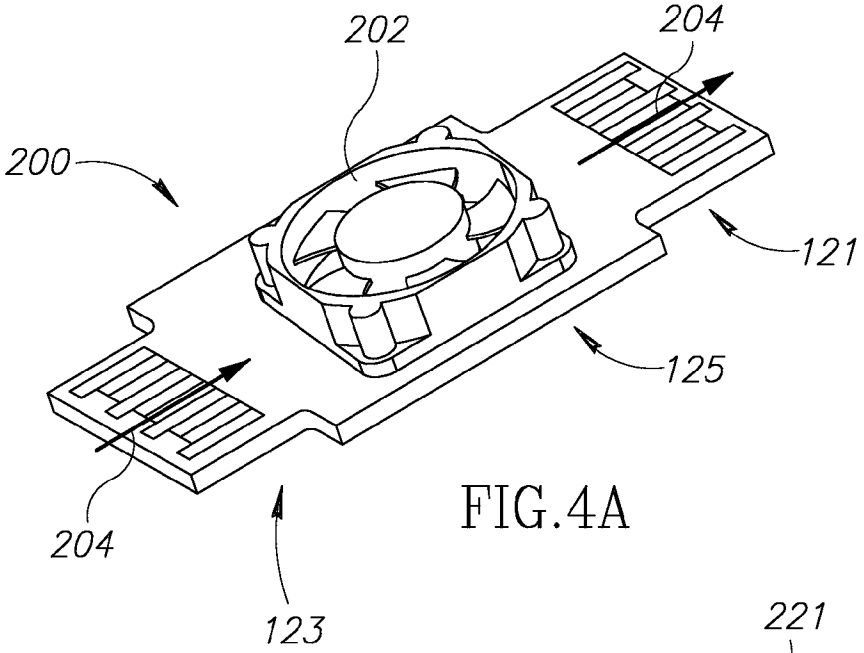

FIG. 4A schematically shows a variation of functionality PCB 120 referred to as functionality PCB 200, having cage connector 121, coupling connector 123 and a functionality region 125, for incorporation in super cage 100, in accordance with an embodiment of the invention. Functionality PCB 200 comprises a mini-fan 202 mounted in functionality region 125 for improving ventilation and thereby improved heat dissipation for an SFP module inserted into the super cage. Functionality region 125 of functionality PCB 200 may comprise functionality circuitry (not shown) that measures temperature in the super cage and controls mini-fan 202 responsive to the measured temperature. For example, below a given predetermined threshold temperature the functionality circuitry may maintain mini-fan 202 turned off. Above the threshold temperature, the functionality circuitry turns on the min-fan to generate airflow in directions indicated by arrows 204. Optionally, the functionality circuitry is located on a side of functionality PCB 200 opposite to that on which mini-fan 202 is located.

FIG. 4B schematically shows a functionality PCB 210 comprising a rechargeable button battery 212 that may be included in super cage 100, in accordance with an embodiment of the invention. In an embodiment of the invention, functionality PCB 210 includes functionality circuitry (not shown) that provides power to an SFP module plugged into the super cage when the SFP loses power. The functionality circuitry is located optionally on a side of the functionality PCB opposite to the side on which disc battery 210 is located. In an embodiment of the invention, the functionality circuitry is configured to control the SFP module to transmit a "dying gasp" alarm to alert a communication network that includes the SFP module that the SFP module is about to lose power.

Figure 4C:
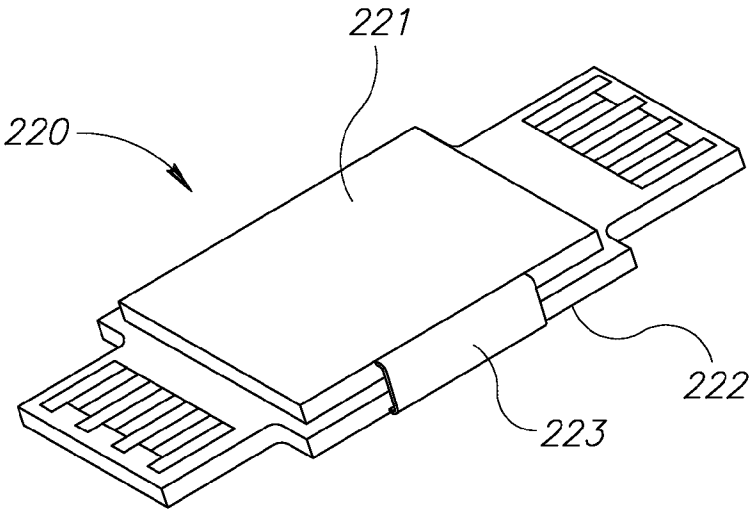

In some embodiments of the invention, functionality circuitry to be included in a functionality PCB is not conveniently included in a functionality PCB having a size and construction shown in FIGS. 3C, 4A, and 4B. FIG. 4C schematically shows a functionality PCB 220 for inclusion in super cage 100 that has increased area for functionality circuitry.

Functionality PCB 220 comprises upper and lower sub-PCBs 221 and 222 respectively. The portions are electrically and physically connected by a flexible neck 223 comprising conductive traces (not shown) that connect functionality circuitry components (not shown) located on bottom portion 222 with functionality circuitry components (not shown) located on top portion 221. In an embodiment of the invention functionality PCB 220 is formed by slotting a PCB to form the two PCB portions connected by the neck region. The neck region is thinned, for example by etching or abrading, to make it sufficiently flexible so that it can be bent to position the PCB portions one over the other, as shown in FIG. 4C.

Figure 4D:
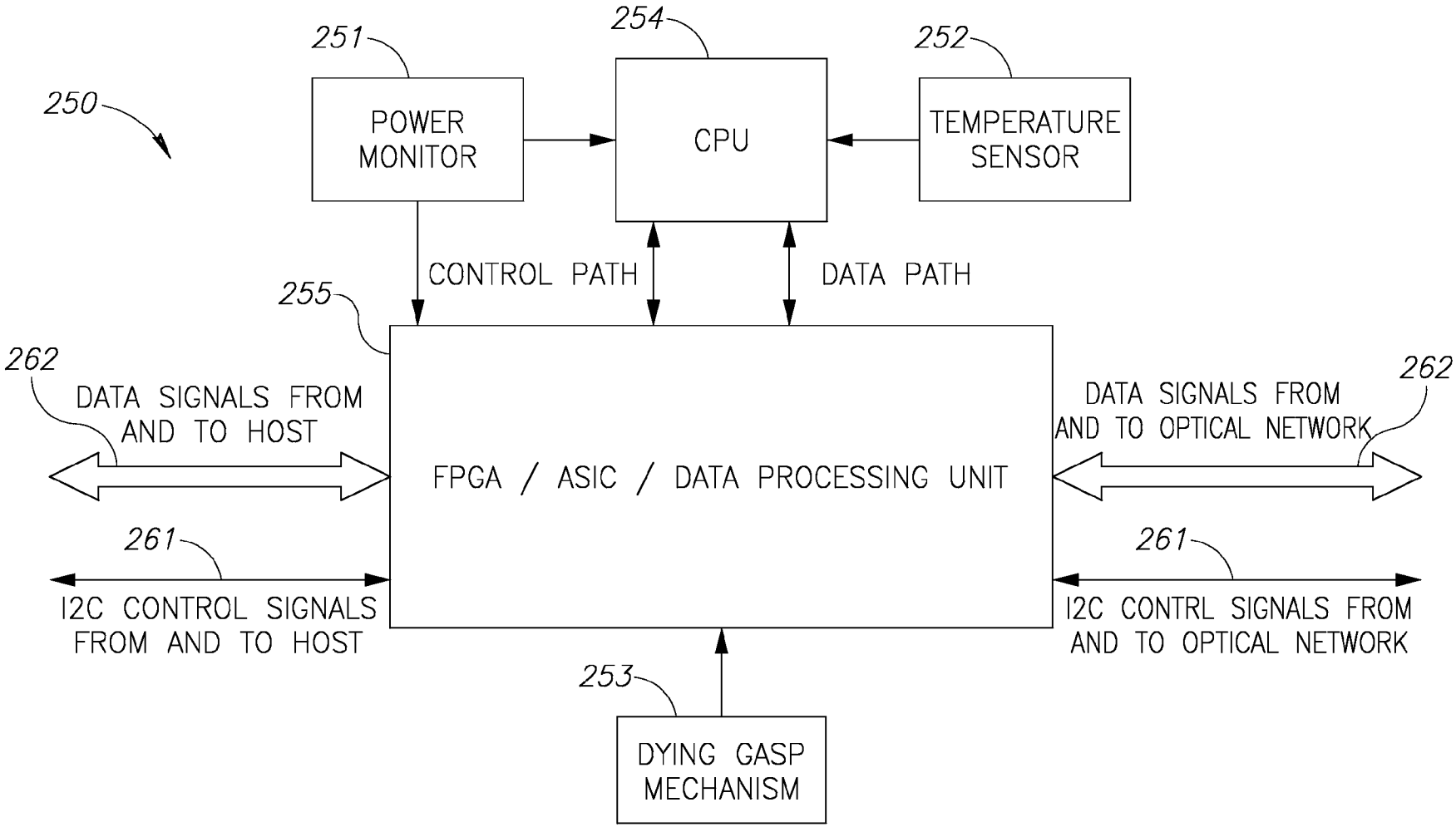
FIG. 4D schematically shows a functionality circuitry, in accordance with an embodiment of the invention.

By way of example, functionality PCB 220 may have functionality circuitry similar to functionality circuitry 250 schematically shown in FIG. 4D. Functionality circuitry 250 optionally comprises a central processor unit (CPU) 254, a communications processing unit 255, a power monitor 251, a temperature sensor 252 and a dying gasp mechanism 253. Voltage monitor 251 monitors voltage provided to super cage 100 and an SFP module, such as SFP transceiver 50, (FIG. 2D) plugged into the super cage. If the voltage supply to the super cage and its SFP module 50 drops below a desired operating voltage, the voltage monitor informs data processing unit 255 and CPU 254. Optionally, CPU 254 generates a dying gasp message to inform the network management system of the loss of voltage. When voltage to super cage 100 returns to a level sufficient for proper operation, voltage monitor 251 awakens CPU 254 and processing unit 255. Temperature sensor 252 acquires readings of ambient temperature and transmits the readings to CPU 254. The CPU uses the readings to report status of the super cage 100 transceiver to a network management system (not shown) and optionally to turn on a mini-fan (not shown).

In the description and claims of the present application, each of the verbs, "comprise" "include" and "have", and conjugates thereof, are used to indicate that the object or objects of the verb are not necessarily a complete listing of components, elements or parts of the subject or subjects of the verb.

Descriptions of embodiments of the invention in the present application are provided by way of example and are not intended to limit the scope of the invention. The described embodiments comprise different features, not all of which are required in all embodiments of the invention. Some embodiments utilize only some of the features or possible combinations of the features. Variations of embodiments of the invention that are described, and embodiments of the invention comprising different combinations of features noted in the described embodiments, will occur to persons of the art. The scope of the invention is limited only by the claims.

The invention claimed is:

1. A receptacle for receiving a small form factor pluggable (SFP) communication module and providing the SFP communication module with a functionality, the receptacle comprising:

a sleeve dimensioned to receive an SFP communication module and be plugged into a conventional SFP cage configured to receive the SFP communication module and having a cage socket for receiving a connector of the SFP module;

functionality circuitry housed in the sleeve;

an edge connector electrically connected to the functionality circuitry and configured to be inserted into the cage socket; and a coupling socket housed in the sleeve that receives the SFP connector of the SFP communication module and electrically connects the SFP connector to the functionality circuitry.

2. A receptacle according to claim 1 wherein the sleeve has a wall thickness equal to about 0.1 mm.

3. A receptacle according to claim 1 wherein the functionality circuitry is comprised in a printed circuit board (PCB).

4. A receptacle according to claim 3 wherein the PCB comprises a coupling connector configured to be plugged into the coupling socket and electrically connect the functionality circuitry to the coupling socket.

5. A receptacle according to claim 4 wherein the edge connector is integrally formed as part of the PCB.

6. A receptacle according to claim 5 and comprising a cowling that houses the edge connector.

7. A receptacle according to claim 6 wherein the cowling is formed having slots into which the PCB seats.

8. A receptacle according to claim 7 wherein the printed circuit board (PCB) is held in place between and by the coupling socket and the cowling.

9. A receptacle according to claim 8 wherein the cowling is formed having recesses, and the sleeve having matching snap tabs that seat in the recesses and lock the cowling in the sleeve.

10. A receptacle according to claim 9 wherein the sleeve is formed having a stop catch and the coupling socket having a matching catch nub that seats in the stop catch and wherein the coupling socket is locked in place by the stop catch and the PCB.

11. A receptacle according to claim 1 and having a spring latch that receives a matching latch button of an SFP module to lock the SFP module in the receptacle when the SFP module is inserted into the receptacle.

12. A receptacle according to claim 1 wherein the receptacle comprises a latch button that matches a spring latch in the conventional SFP cage and seats in the spring latch to lock the receptacle in the conventional SPF cage when the receptacle is inserted into the conventional SPF cage.

13. A receptacle according to claim 12 wherein the receptacle comprises a release slider operable to be translated along the length of the receptacle to depress the spring latch in the conventional SFP cage and release the latch button from the spring latch.

14. A receptacle according to claim 1 wherein the functionality circuitry comprises electric circuitry, and/or a Field Programmable Gate Array (FPGA), and/or an Application Specific Integrated Circuit, and/or a Central processing Unit (CPU).

15. A receptacle according to claim 1 wherein the functionality circuitry is configured to generate dying-gasp messages.

16. A receptacle according to claim 1 wherein the functionality circuitry comprises a mini-fan for generating air-flow in the receptacle.

17. A receptacle according to claim 1 wherein the functionality comprises functionality of an Ethernet Network Interface Device (NID) or Ethernet Network Termination Unit (NTU).

18. A receptacle according to claim 1 wherein the functionality circuitry is configured to provide packet inspection, statistics collection, packet header editing, packet insertion and removal, and/or traffic conditioning.

19. A receptacle according to claim 18 wherein packet inspection detects anomalous or potentially malicious packets, or classifies packets and collects statistics regarding applications in use, or monitors and optionally controls traffic flows.

20. A receptacle according to claim 18 wherein packet header editing is employed for packet marking, manipulation of Ethernet VLAN tags, manipulation of MPLS label stacks, or protocol conversion.

* * * * *